United States Patent [19]

Bachhofer et al.

[11] Patent Number: 4,609,900

[45] Date of Patent: Sep. 2, 1986

[54] HIGH-VOLTAGE TRANSFORMER WITH LIQUID COOLING

[76] Inventors: Bruno Bachhofer, Säntisstrasse 85, D-7981 Bavendorf; Anton Locher, Bergstrasse 6, D-7981 Torkenweiler, both of Fed. Rep. of Germany

[21] Appl. No.: 745,371

[22] Filed: Jun. 17, 1985

Related U.S. Application Data

[63] Continuation-in-part of Ser. No. 624,707, Jun. 26, 1984, abandoned.

[51] Int. Cl.[4] ..... H01F 27/14

[52] U.S. Cl. ..... 336/58; 174/11 R; 174/12 R

[58] Field of Search ..... 174/11 R, 12 R, 17 VA, 174/15 R, 50, 52 S; 336/55, 57, 58, 94

[56] References Cited

U.S. PATENT DOCUMENTS

| | | | |
|---|---|---|---|
| 2,016,247 | 10/1935 | Simmons | 174/12 R |
| 2,028,589 | 1/1936 | Clark | 174/12 R X |
| 2,194,604 | 3/1940 | Malsbary | 174/11 R X |
| 3,123,783 | 3/1964 | Wilk et al. | 174/12 X |
| 3,123,784 | 3/1964 | Ritz | 174/12 R X |
| 3,260,974 | 7/1966 | Specht et al. | 174/15 R |
| 3,448,219 | 6/1969 | Nakazawa et al. | 336/58 X |
| 3,670,276 | 6/1972 | Theodore | 336/94 X |
| 3,755,614 | 8/1973 | Jakacki | 174/52 S X |
| 3,853,291 | 12/1974 | Burke | 174/50 X |
| 4,092,484 | 5/1978 | Majkrzak et al. | 174/12 R |

FOREIGN PATENT DOCUMENTS

| | | | |
|---|---|---|---|
| 203336 | 4/1966 | Sweden | 174/12 R |

OTHER PUBLICATIONS

IBM Technical Disclosure Bulletin, Gupta et al, "Protection Device for Fluid-Cooled Electrical Apparatus," vol. 24, No. 2, Jul. 1981, p. 955.

*Primary Examiner*—Thomas J. Kozma
*Attorney, Agent, or Firm*—Spencer & Frank

[57] ABSTRACT

In a high-voltager transformer including a closed casing, a magnetic core with at least one winding, a cooling liquid filling the casing and surrounding the winding, and insulated casing lead-throughs for connecting external lines to the winding, a compensating device forms part of the casing and is exposed to the cooling liquid for permitting expansion of the cooling liquid on being heated, and the cooling liquid is subjected to a pressure greater than that of the ambient air at all operating temperatures of the transformer.

6 Claims, 2 Drawing Figures

HIGH-VOLTAGE TRANSFORMER WITH LIQUID COOLING

This application is a continuation in-part of application Ser. No. 624,707, filed June 26, 1984, now abandoned.

BACKGROUND OF THE INVENTION

The present invention relates to a high-voltage transformer with liquid cooling, especially for use inside a subassembly composed of electromechanical components which have been assembled in a crowded arrangement, this transformer comprising a magnetic core with a winding, a cooling liquid surrounding this winding, a casing and insulated casing lead-throughs for external connecting lines.

Comparatively small, liquid-cooled transformers of this type are encountered exceptionally rarely, since the cooling-liquid expansion container, which is usually open, renders the transformer orientation-dependent, which excludes it from many possible applications. Moreover, the known oil-filled transformers are bulky, and are accordingly unsuitable for installation conditions involving extreme space limitations.

For these reasons, small high-voltage transformers for limited-space installation conditions, for example, for X-ray equipment, copiers, and the like are nowadays, almost without exception, potted in casting resin, and are air-cooled. Resin-potted transformers, however, are suitable only for very low power outputs, or when they are switched on for proportionately short periods. In order to be able to withstand the thermal expansions, the casting resins which are used must be adjusted in a manner whereby they are rendered soft. However, they become brittle within a comparatively short time, the consequence of this being that transformers which are under continuous load finally fail as a result of the breakdown of their insulations.

SUMMARY OF THE INVENTION

The object underlying the invention is to provide a high-voltage transformer for installation conditions involving extreme space limitations, this transformer being both orientation-independent and capable of continuous operation, under confined-space conditions, up to ratings in the region of 1 kVA.

Starting from a liquid-cooled high-voltage transformer of the type indicated in the introduction, this object is achieved, according to the invention, by means of an arrangement whereby the casing contains a compensator which takes up the volume by which the cooling liquid expands on being heated, and whereby, at all operating temperatures, the cooling liquid is subject to an overpressure, relative to the pressure of the ambient air. A transformer casing which, in consequence, is hermetically sealed is orientation-independent, i.e., can be oriented in any desired manner, and requires less installation space as a result of the abandonment of the expansion container which, in other designs, is open, and the elimination of the connecting pipelines associated therewith. The overpressure to which the cooling liquid is subject increases the resistance to breakdown of the electrical insulation and thereby makes it easier to achieve a compact form of construction. During operation under load, the overpressure increases still further, and this once again increases the degree of safety with regard to insulation breakdowns.

The compensator is preferably designed as roll-over membrane which is inset into an aperture in the casing wall, to which it is sealed, and which is subjected from the outside, to the pressure exerted by a spring. The overpressure is defined by the spring pre-load. If, as a result of heating or cooling, the volume of the cooling liquid changes, the pressure changes in a manner which is related to the spring characteristic. The occurrence of excessive volumes, accompanying unforeseen overloading of the transformer, can be prevented by taking the precaution of installing a pressure-release valve or similar device. Furthermore, it is self-evident that the cooling liquid, preferably silicone oil, must be carefully deaerated and dehydrated.

Silicone oil, moreover, is unobjectionable with regard to foodstuff regulations and presents no hazard to ground water. For this reason, the oil catch-pan, indispensable in the case of the known oil-filled transformers, is superfluous.

While oil-filled transformers conventionally possess outward-projecting lead-through insulators, which necessitate a safety clearance, it is proposed, in a further embodiment of the invention, that a flat plate, composed of an insulating material, be used as a casing cover and, at the same time, as the insulator for at least the casing lead-through serving the high-voltage side of one or more windings. The plate is preferably manufactured from a transparent plastic possessing insulating properties, which offers the possibility not only of observing the manner in which the connecting lines run once the cover has been closed, but also permits observation of the foaming which occurs during the processes of introducing and drying the cooling liquid. Furthermore, the plate, composed of an insulating material, can be employed as an excess-pressure protection device, by distributing its securing screws around the periphery in an irregular arrangement, such that a portion of the plate flexes elastically when the pressure becomes excessive, lifts away slightly and thereby relieves the pressure on the seal and enables cooling liquid to drip out.

BRIEF DESCRIPTION OF THE DRAWING

In the text which follows, an illustrative embodiment of the invention is explained by reference to the drawing, in which, in detail.

DESCRIPTION OF THE PREFERRED EMBODIMENTS

Figure 1:
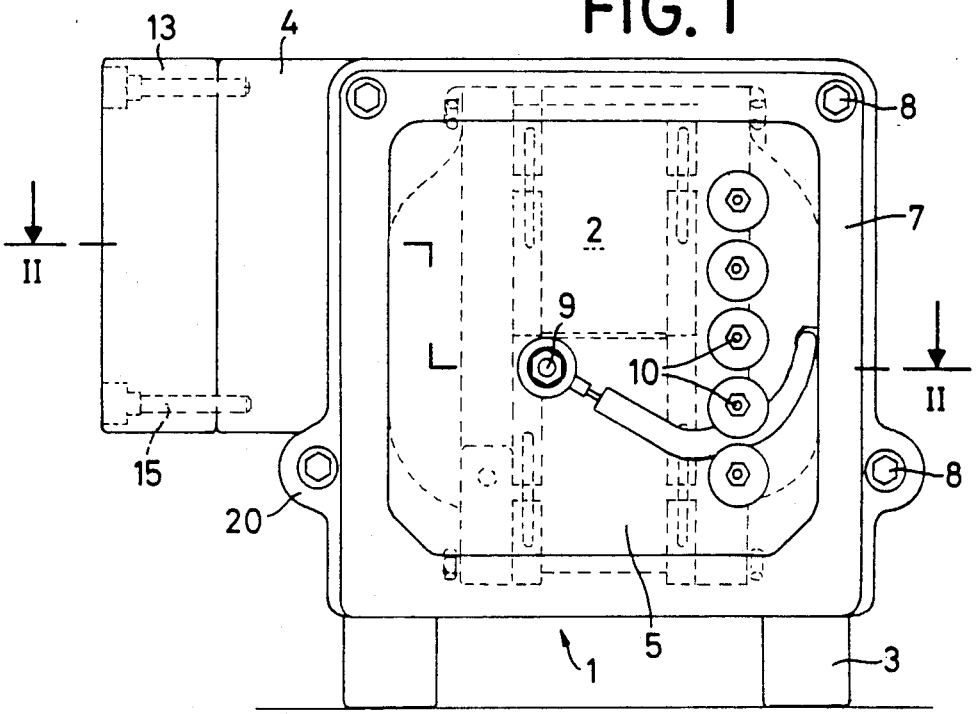
FIG. 1 is an elevational view, from the cover side, of a transformer according to a preferred embodiment of the invention.
Figure 2:
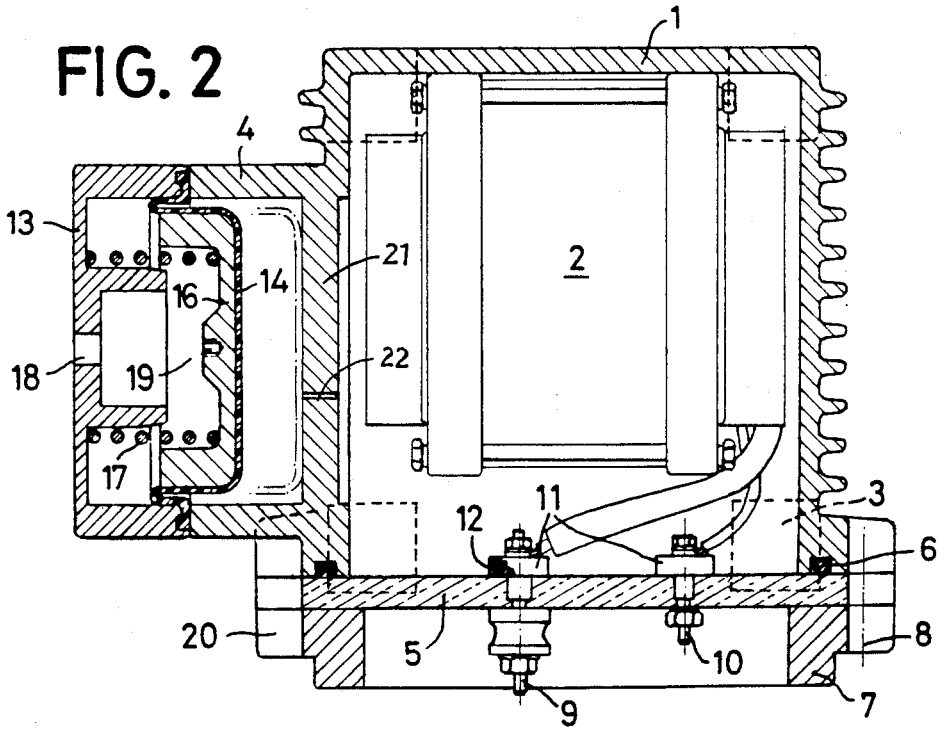
FIG. 2 is a horizontal cross-sectional view along the line II—II through the transformer depicted in FIG. 1.

FIGS. 1 and 2 show a transformer assembly 2, comprising a core and windings, located inside a cast-aluminum casing 1 which is provided, on its sides, with cooling fins. The casing 1 rests on four feet 3, and possesses a front aperture for the insertion of the transformer assembly 2, the edge area surrounding this aperture being flat, as can be seen in FIG. 2. A square connection piece 4 is attached to the left-hand side face of the casing 1, and is terminated, at the side directed toward the interior of casing 1, by a wall 21 which constitutes a continuation of casing 1. Wall 21 is provided with at least one small bore 22 via which the interior of casing 1 communicates with the region enclosed by connection 4.

The insertion aperture in the casing 1 is closed by means of a transparent polyacrylate plate 5, approximately 10 mm thick. In order to effect a seal, a sealing ring 6 is inserted into a groove which extends around the periphery of the flat edge area of the casing 1. A frame 7 is fitted to the plate 5, from the outside and is secured to the casing 1 with the aid of four through-screws 8.

The plate 5 serves as the lead-through insulator for the high-voltage connection 9 and also, at the same time, as the lead-through insulator for a plurality of low-voltage connections 10, the selection of which enables the high-voltage to be set between 9 and 12 kV. The other end of the high-voltage winding is grounded. Circular flanges 11 are molded onto lead-through pins, on the inside, these flanges 11 containing sealing rings 12 which bear against the plate 5. As a result, the insertion aperture in the casing 1 is hermetically sealed.

In order to form a compensator, a cap 13 is placed on the connection piece 4, this cap 13 clamping in a roll-over membrane 14 and being secured tightly to piece 4 by four screws 15. This roll-over membrane 14 is consequently sealed at its edge, and closes the connection piece opening. The roll-over membrane 14 places itself around a supporting body 16 which, in its turn, is supported, via a compression spring 17, on the cap 13, which possesses a central hole 18 to the outside.

The casing 1 is filled with silicone oil and, at a room temperature of 20° C., is subject to an overpressure of approximately 0.5 bar. The filling operation proceeds as follows: in a first step, the casing 1 is subjected to a vacuum together with the transformer assembly 2, which has been positioned inside it, thereby predrying these components. During this first step, movement of membrane 14 is limited by wall 21. If wall 21 were not present, the vacuum, which is also established at the interior of connection 4 via bore 22, could pull membrane 14 into the interior of casing 1 and into contact with transformer 2, which could lead to destruction of membrane 14.

Silicone oil is then admitted, slowly, through a valve which is not shown in the drawing. As the oil enters, it foams vigorously, and this foaming can be observed, with advantage, through the transparent plate 5, and it is also possible, incidentally, to observe whether the transformer assembly 2 and the connecting lines are correctly positioned. If, as a result of the continued evacuation, the foaming abates, additional silicone oil is then admitted, until the interior of the casing is completely filled, and all air bubbles have escaped. Additional silicone oil is now supplied, in a subsequent topping-up operation, employing a metering pump, thereby bringing about the above-mentioned overpressure. The position of the roll-over membrane 14 can be monitored by means of a pin—not shown in the drawing—which is screwed into a thread 19 in the supporting body 16, and is allowed to project beyond the cap 13. In the event of temperature fluctuations during operation, the volume changes are compensated by corresponding breathing movements of the roll-over membrane 14. For design purposes, a temperature of 80° C. is assumed to prevail inside the casing.

In order to prevent the pressure inside the casing 1 from becoming excessive, the screws 8, serving to brace the frame 7 and the plate 5, are arranged in a particular manner. Two of these screws are seated in the two upper corners of the frame 7, which is approximately square in shape, while the other two are laterally offset, outwards, with the aid of special fastening tabs 20, and are located at a level corresponding to approximately a quarter of the overall height of the frame 7. The effect of this arrangement is that those portions of both the plate 5 and the frame 7 which project downwards beyond these fastening tabs 20 yield to the bending load which acts concurrently with an increased internal pressure, and the plate lifts slightly, at its lower edge, clear of the sealing ring 6, or merely relieves the load on this ring. A predetermined leakage point is thereby provided, via which the internal pressure can be released. In addition, or as an alternative, an electrical warning signal could also be given, by means of the abovementioned pin, as soon as the roll-over membrane 14 and the supporting body 16 reach a predetermined position which signals that the pressure has become excessive.

The above description relates to a high-voltage transformer, intended for operating ozone generators which are employed for water treatment purposes, and which are housed in very confined containers or casings. In this case the output, in continuous operation, is 800 VA. Since the use of silicone oil represents a feature of the invention, data regarding a specific type, which can be employed, are given as follows:

| | |
|---|---|
| Type: | Wacker Siliconöl TR 50 |
| Producer: | Wacker-Chemie GmbH<br>D-8000 München 22 |
| Viscosity: | 55 $mm^2/s$ at 20° C.<br>40 $mm^2/s$ at 40° C. |
| Graphic formula: | $CH_3-\underset{CH_3}{\overset{CH_3}{Si}}-O-\left[\underset{CH_3}{\overset{CH_3}{Si}}-O\right]_n-\underset{CH_3}{\overset{CH_3}{Si}}-CH_3$ |

It will be understood that the above description of the present invention is susceptible to various modifications, changes and adaptations, and the same are intended to be comprehended within the meaning and range of equivalents of the appended claims.

What is claimed is:

1. A high-voltage, liquid cooled, orientation-independent transformer comprising: a transformer core with at least one winding having a high-voltage end; a hermetically sealed housing enclosing said core, said housing having an installation opening for installation of said core; a mass of cooling and electrical insulating liquid filling said housing and surrounding said core and winding; mechanically expansible compensating means composed of a roll-over membrane attached directly to said housing and communicating with said mass of liquid for permitting expansion of said liquid upon being heated; pressure applying means comprising a spring element acting on said membrane at the side of said membrane directed away from said cooling liquid for subjecting said cooling liquid to a pressure greater than that of the ambient air at all operating temperatures of said transformer; a flat plate of an electrical insulating material covering said installation opening and constituting an insulating lead-through for connection of an external conductor to the high-voltage end of said winding, with said housing being provided with a planar contact face surrounding said installation opening and provided with a circumferential groove; a sealing member disposed in said groove and arranged to contact said plate for normally establishing a sealed joint between said housing and said plate; and screw means fastening said plate to said housing and located for permitting a portion of said plate to deform by flexing elastically when the pressure inside said housing exceeds a selected value, to thereby permit cooling liquid to flow out of said housing.

2. High-voltage transformer according to claim 1, wherein the insulating material forming said plate is a transparent plastic.

3. High-voltage transformer according to claim 1, wherein said colling liquid is silicone oil.

4. High-voltage transformer according to claim 1, further comprising a barrier disposed for preventing said compensating means from contacting said magnetic core.

5. A transformer as defined in claim 1 further comprising a frame provided with a plurality of fastening bores, and wherein said screw means extend through said bores for fastening said plate to said housing via said frame.

6. A transformer as defined in claim 1 wherein said housing is completely filled with said liquid.

* * * * *